US006019462A

United States Patent [19]

Noaki

[11] Patent Number: 6,019,462

[45] Date of Patent: Feb. 1, 2000

[54] INK TANK AND INK JET CARTRIDGE

[75] Inventor: Hiroaki Noaki, Sakae-machi, Japan

[73] Assignee: Canon Kabushiki Kaisha, Tokyo, Japan

[21] Appl. No.: 08/726,164

[22] Filed: Oct. 4, 1996

[30] Foreign Application Priority Data

| | | | |
|---|---|---|---|
| Oct. 9, 1995 | [JP] | Japan | 7-261591 |
| Jun. 27, 1996 | [JP] | Japan | 8-167442 |
| Sep. 24, 1996 | [JP] | Japan | 8-251656 |

[51] Int. Cl.[7] ..... M41J 2/175

[52] U.S. Cl. ..... 347/86

[58] Field of Search ..... 347/14, 84, 85, 347/86, 87

[56] References Cited

U.S. PATENT DOCUMENTS

| | | | |
|---|---|---|---|
| 5,138,344 | 8/1992 | Ujita | 347/86 |
| 5,315,317 | 5/1994 | Terasawa et al. | 347/85 |
| 5,506,611 | 4/1996 | Ujita et al. | 347/86 |
| 5,604,523 | 2/1997 | Tsukuda et al. | 347/86 |
| 5,652,610 | 7/1997 | Kawai et al. | 347/87 |

FOREIGN PATENT DOCUMENTS 57-63285 4/1982 Japan .

*Primary Examiner*—N. Le
*Assistant Examiner*—Anh T. N. Vo
*Attorney, Agent, or Firm*—Fitzpatrick, Cella, Harper & Scinto

[57] ABSTRACT

An ink tank is provided with a plurality of ink retaining units having given ink retaining capacities to retain a plurality of different ink, a housing to constitute the ink retaining units and a plurality of ink supply units to let out ink externally corresponding to the ink retaining units. In this ink tank, each ink selected suitably for the kind of recording data to be used is retained in each of the plural ink retaining units, respectively, irrespective of given ink retaining capacities, and the housing is provided with an information indication portion to indicate such kind of recording data. With the ink tank thus structured, the user can easily select an ink tank best suited for a printing pattern as desired, thus making it possible to utilize the ink tank more economically, and print on a designated number of recording sheets assuredly.

7 Claims, 2 Drawing Sheets

INK TANK AND INK JET CARTRIDGE

BACKGROUND OF THE INVENTION

1. Field of the Invention

The present invention relates to the field of ink jet recording. More particularly, the invention relates to an ink tank retaining in it a plurality of different kinds of ink together, and relates to an ink jet cartridge.

2. Related Background Art

For a calculator, a wordprocessor, facsimile equipment, a copying machine, a printer, or various other equipment, for example, an ink jet recording apparatus (hereinafter referred to as an ink jet printer) is widely used as means for recording on a recording medium such as a recording sheet, because not only it can record at high speeds with a lesser amount of noises, but also, it can record color images easily.

An ink tank used for the ink jet printer described above is to supply ink to the ink jet recording head that discharges ink from its ink discharge ports for recording. Here, an ink tank having plural ink retaining units in it may be used in some cases when plural kinds of ink are used for color printing in particular.

Also, in recent years, from the viewpoint of making the apparatus smaller, or the like, an ink jet cartridge, which can form an ink tank integrally with a recording head, has become the main current of use. Such ink jet cartridge is detachably mountable on a recording apparatus. The cartridge can be classified into the one structured to keep its recording head unit and an ink tank to be integrated at all times, and the one structured to have its recording head unit and an ink tank formed separately and put them together at the time of use. In either mode, a structure is known to form a plurality of ink retaining units in an ink tank for recording in colors.

For an ink tank or an ink jet cartridge used for color recording as described above, it is usually arranged to fill in either of them with the different kinds of color ink each in the same amount, and in accordance with applicable printing data, each color ink is discharged from the ink discharge ports as designated. For example, three kinds of color ink, yellow (Y), magenta (M), and cyan (C), are prepared, respectively, and when a printer performs a multiple color printing in accordance with the applicable color printing data, the designated colors are appropriately selected for printing from among the three kinds of ink described above depending on the contents of such printing data.

Compared to the case where each individual ink tank is used for each color, the structure described above has an advantage that there is no possibility of mounting an ink tank of different color erroneously, while the ink tank can be provided at lower costs because there is no need for the provision of any particular arrangement to prevent erroneous mounting or the like. Also, for an ordinary use, the average consumption of Y, M, and C is not extremely different from each other. Therefore, with the structure thus arranged, ink remainders do not present any problem that may require extremely severe attention.

Nevertheless, in accordance with the prior art described above, the ink tank becomes no longer usable if only ink of a specifically designated color is used for printing and ink of such color is completely consumed, while ink of the other colors still remains in the ink tank. Here, therefore, the problem of ink remainders still exists.

As one solution of a problem of the kind, the capacity of each ink chamber is made different, larger or smaller, depending on the anticipated consumption of each ink when arranging a plurality of chambers to retain a plurality of color ink, respectively, as disclosed in Japanese Patent Publication No. 2-5587.

However, if there are included many of the patterns that require only a specifically designated color for printing, it is necessary to arrange each chamber differently, larger or smaller, corresponding to the anticipated consumption of each ink as the case may be each time. An arrangement of the kind leads to increased costs inevitably. This is not economical after all.

SUMMARY OF THE INVENTION

The present invention is designed with a view to solve the problems encountered in the prior art. It is an object of the invention to provide an inks tank and an ink jet cartridge retaining each of color inks in the respective amounts suitable for the contents to be recorded, which can be selected for use economically.

In order to achieve the object described above, an ink tank of the present invention is provided with a plurality of ink retaining units having given ink retaining capacities to retain a plurality of different ink; a housing to constitute the ink retaining units; and a plurality of ink supply units to let out ink externally corresponding to the ink retaining units, wherein each ink selected suitably for the kind of recording data to be used is retained in each of the plural ink retaining units, respectively, irrespective of given ink retaining capacities, and the housing is provided with an information indication portion to indicate such kind of recording data.

Also, in order to achieve the object described above, the ink jet cartridge of the present invention comprises an ink tank provided with plural ink retaining units having given ink retaining capacities to retain a plurality of different ink; a housing to constitute the ink retaining units; and a plurality of ink supply units to let out ink externally corresponding to the ink retaining units, in which each ink selected suitably for the kind of recording data to be used is retained in each of the plural ink retaining units, respectively, irrespective of given ink retaining capacities, and the housing is provided with an information indication portion to indicate such recording data; and an ink jet head unit connected with the plural ink supply units of the ink tank, having a plurality of discharge ports to discharge ink.

The ink tank and the ink jet cartridge described above are both capable of achieving the above-mentioned objective, but for setting a more preferable condition, at least either one of the number of recording sheets effectively usable for the retained ink, respectively, and each amount of the retained ink should be described on a portion on the housing thereof to indicate information on the recording data.

BRIEF DESCRIPTION OF THE DRAWINGS

FIG. 2A illustrates the state that the recording head and ink tank unit are coupled; and FIG. 2B illustrates the state that only the ink tank unit is drawn out.

DETAILED DESCRIPTION OF THE PREFERRED EMBODIMENTS

Hereinafter, with reference to the accompanying drawings, the description will be made of the embodiments in accordance with the present invention.

(First Embodiment)

Figure 1:
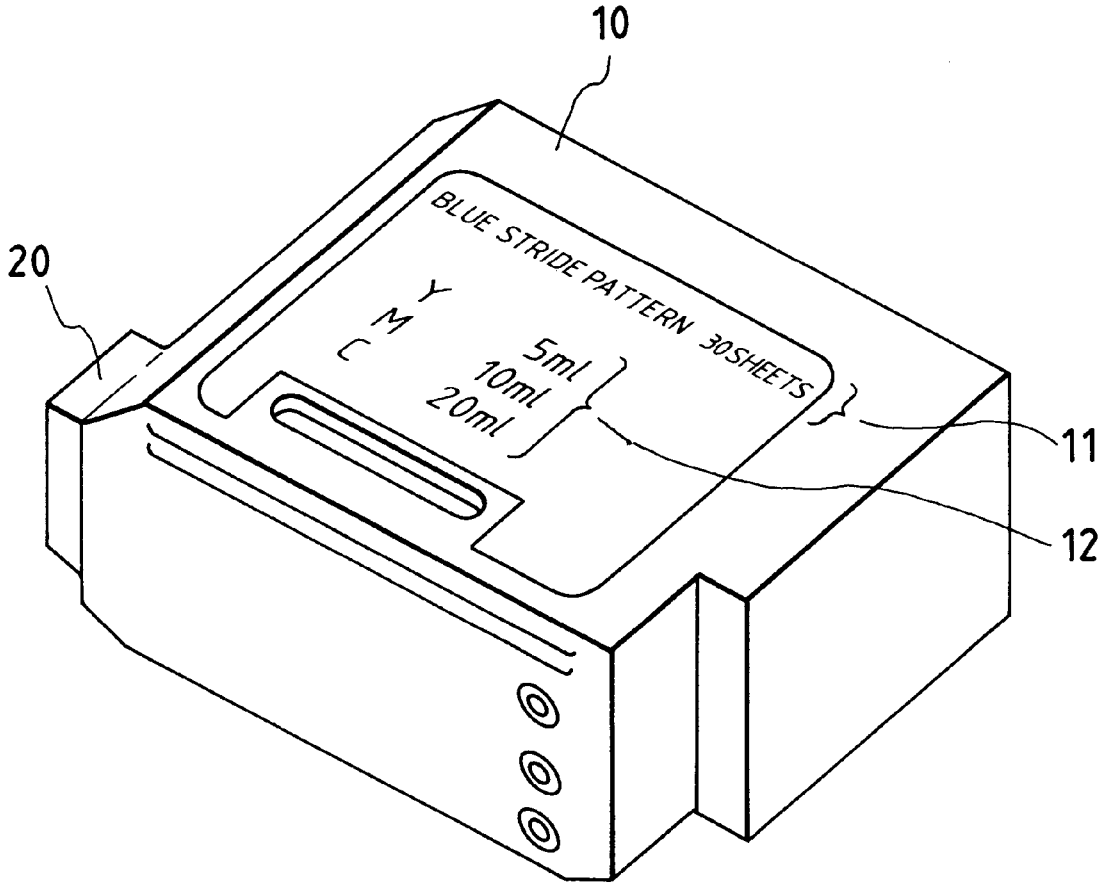
FIG. 1 a perspective view which shows an ink jet cartridge to which the present invention is applicable.

FIG. 1 is a perspective view schematically showing an ink jet cartridge in accordance with a first embodiment of the present invention.

In FIG. 1, a reference numeral 10 designates an ink jet cartridge retaining a plurality of color ink, which is formed by a recording head unit 20 having a plurality of ink discharge ports integrally with an ink tank unit that retains ink, and structured to be inseparable. The ink jet cartridge is detachably mountable on a carriage of an ink jet recording apparatus (not shown), which can perform scanning, and is capable of discharging color ink from the ink discharge ports toward a recording medium in accordance with color printing data.

The ink jet cartridge of the present embodiment comprises three ink retaining units, which contain ink of three colors, yellow (Y), magenta (M), and cyan (C), respectively. Each of the three ink retaining units can store substantially an equal amount of ink.

Now, the description will be made of the structural features of the present embodiment. The actual ink retaining amount for each color is set in accordance with various kinds of color printing data to be used. As shown in FIG. 1, on the color ink jet cartridge, a print example indication portion 11 is provided as an information indicating portion to show the kind of recording data: the name of print pattern to be used, and the number of printable sheets, and an ink capacity indication portion 12 to indicate each of the color ink retaining amounts in the ink jet cartridge.

For the present embodiment, the color ink jet cartridge is for printing blue pattern (blue slide pattern) to be utilized as the background color for materials to be presented at a scientific society or the like. For each of ink retaining portions of Y, M, and C, ink is retained, respectively, to be Y=5 ml, M=10 ml, and C=20 ml, which can print 30 sheets in the pattern described above. In accordance with the present embodiment, an indication "BLUE SLIDE PATTERN 30 SHEETS" is marked on print example indication portion 11 in order to indicate the kind of recording data as described above, and also, indications "Y=5 ml, M=10 ml, C=20 ml" are marked on ink capacity indication portion 12.

If a print pattern is different from that of the embodiment described above, the ink retaining amounts for the respective colors should be determined in accordance with each of the ink consumptions required for printing such a pattern, and each color ink should be filled in the ink tank accordingly. Then, the kind of recording data is indicated on the information indicating portion on the cartridge. In this case, it is more preferable to make an arrangement so that the actual retaining amount of ink to be used most is made available in an amount equal to the maximum capacity set for the ink retaining units. With an arrangement of the kind, it becomes possible to maximize the number of printable sheets per ink tank, and reduce the frequency of replacing ink tanks.

In other words, if the ratio of consumptions of the respective color ink to print a pattern A is Y:M:C =4:3:3, while the maximum capacity set for the ink retaining units is 20 ml, the respective ink retaining amounts of an ink tank for the use of pattern A becomes Y=20 ml, M=15 ml, and C=15 ml. Also, now, if a pattern B should require the ratio of ink consumptions of Y:M:C:=2:4:3 for the same ink cartridge, each amount of ink to be injected into this ink tank is: Y=10 ml, M=20 ml, C=15 ml. Then, information such as the number of printable sheets for the pattern B and others are indicated on the information indication portion on the cartridge accordingly.

As described above, the actual ink retaining amount for each color is determined in accordance with the consumption of each color ink for the respective patterns. In this way, it is possible to provide an ink jet cartridge capable of using ink without waste, and to dispense with manufacturing cartridges anew corresponding to each ratio of ink consumptions.

(Second Embodiment)

Figure 2A:
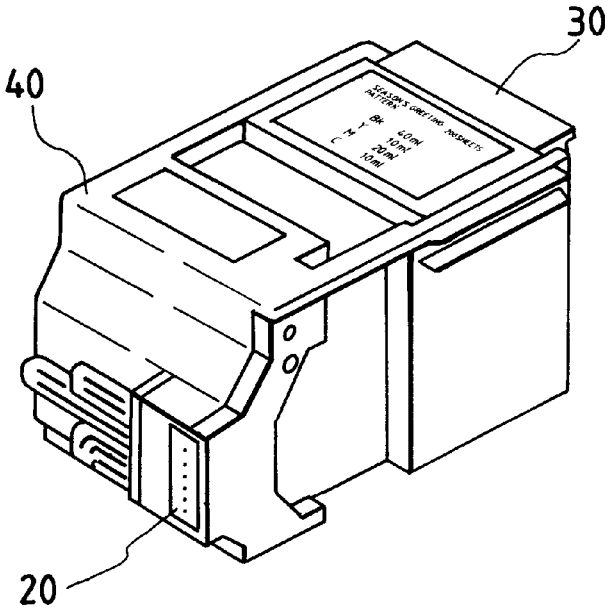
FIGS. 2A and 2B are perspective views showing an ink jet cartridge to which the present invention is applicable.
Figure 2B:
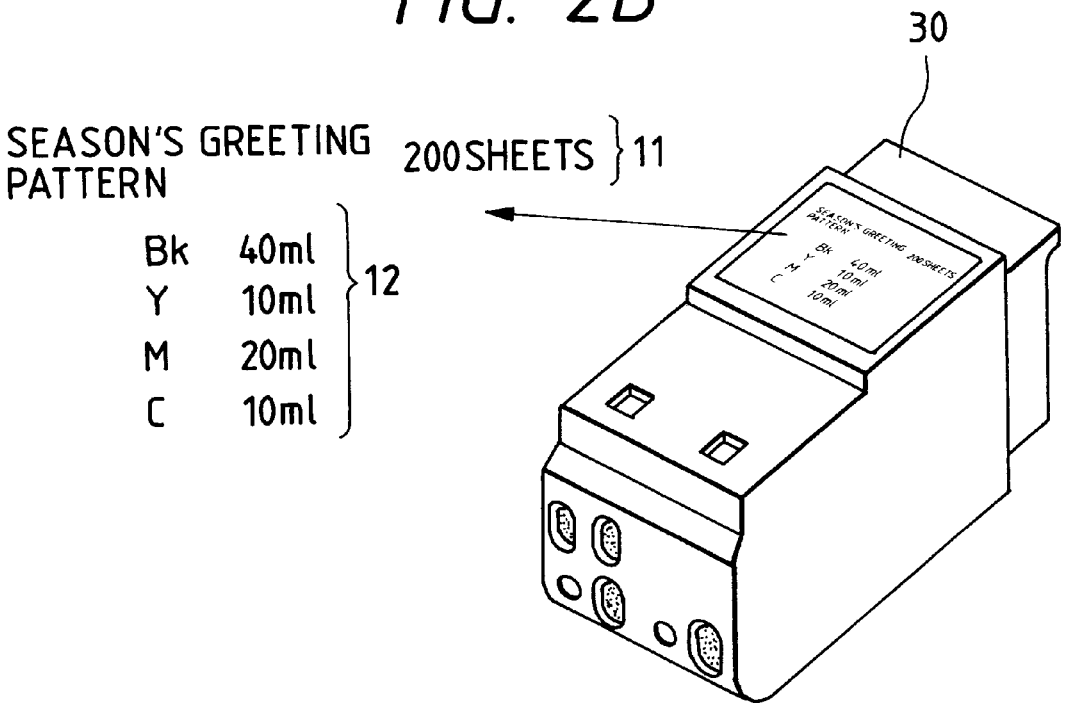

FIGS. 2A and 2B are perspective views schematically showing an ink jet cartridge in accordance with a second embodiment of the present invention. FIG. 2A shows the state that the recording head and the ink tank unit are coupled. FIG. 2B shows the state that only the ink tank unit is drawn out.

In this respect, a reference numeral 40 designates a cartridge case, which is provided with a recording head unit 20 discharging a plurality of ink droplets, and, an ink tank 30 provided with four ink retaining units in which four kinds of color ink, yellow (Y), magenta (M), cyan (C), and black (Bk), are retained, respectively. When the cartridge is used, the ink tank 30 and the recording head unit 20 are coupled as shown in FIG. 2A by means of a coupler (not shown). The cartridge is detachably mounted for use on the carriage of an ink jet recording apparatus, which performs scanning.

For the present embodiment, the three ink retaining units of Y, M, and C are arranged to retain substantially the same amount of ink, while the one to retain Bk is arranged to hold more ink than those three ink retaining units. Of course, it may be possible to make the size of the Bk ink retaining portion the same as the those of the other portions as in the case of the first embodiment. Here, however, there is no particular need for making each of the ink retaining units in the same size. Thus, the ink retaining capacity of each color ink retaining unit can be set appropriately in advance as in the present embodiment.

In the present embodiment, too, each actual color ink retaining amount is set corresponding to the kind of color printing data to be used as in the first embodiment. As shown in FIG. 2B, there are arranged on the ink tank a print example indication portion 11 to indicate the name of print pattern to be used together with the number of printable sheets, and an ink capacity indication portion 12 to indicate each of the color ink retaining amounts in the ink tank as information that indicates the kind of recording data.

For the present embodiment, the cartridge is to print season's greeting patterns, such as a New Year greeting patterns, which require the ratio of ink consumptions of Bk:Y:M:C=4:1:2:1, and the maximum ink retaining capacity set for the ink tank is 40 ml for Bk and others, 20 ml each. In order to maximize the number of printable sheets per ink tank, each amount of ink to be injected into the ink tank should be set at Bk=40 ml, Y=5 ml, M=10 ml, and C=5 ml, respectively, and as in the first embodiment, the kind of recording data is indicated on the information indication portion.

Here, for the second embodiment, too, ink tanks for use of several kinds of print patterns are prepared as needed in advance as in the first embodiment, and the user selects the best suited ink tank for each of print patterns from among those prepared in advance.

As described above, in accordance with the present invention, it is possible for the user to select ink jet cartridges easily for use of the respective print patterns. Hence, ink jet cartridges can be utilized economically. Further, printing can be made reliably on a designated number of sheets. As a result, there is no need for the provision of any mechanism on the recording apparatus side to detect remainders, thus providing an advantage that the apparatus can be made simpler.

Also, for all the embodiments described above, the description has been made of an cartridge using color ink, but the present invention is not necessarily limited to the use of color ink if only ink to be retained in the ink tank are a plurality of different ones. For example, the present invention is applicable to the use of light and shade ink combination or combination of ink and pre-processing liquid or post-processing liquid, among some others.

What is claimed is:

1. An ink tank, comprising:

a plurality of ink retaining units, each having a same ink retaining capacity, the plural ink retaining unit to retain respective ones of a plurality of different inks; and a housing enclosing said ink retaining units, wherein each of said plurality of ink retaining units retains an amount of ink selected according to recording data to be recorded, at least one of the amounts being less than the same ink retaining capacity, and wherein said housing includes an information indication portion describing said recording data.

2. An ink tank according to claim 1, wherein said information indication portion describes either a number of recording sheets of the recording data recordable using the amounts of the plurality of inks or said retained amount of each ink.

3. An ink tank according to claim 1, wherein a different color ink is retained in each of said plurality of ink retaining units.

4. An ink jet cartridge comprising:

an ink tank provided with plural ink retaining units, each having a same ink retaining capacity, the plural ink retaining units to retain respective ones of a plurality of different inks;

a housing enclosing said ink retaining units, each of said plural ink retaining units retaining an amount of ink selected according to recording data to be recorded, at least one of the amounts being less than the same ink retaining capacity, and said housing including an information indication portion describing such recording data; and an ink jet head unit, connected with said ink tank, having a plurality of discharge ports to discharge ink.

5. An ink jet cartridge according to claim 4, wherein said ink jet head unit and said ink tank are structured to be detachable from one another.

6. An ink jet cartridge according to claim 4, wherein said information indication portion describes either a number of recording sheets of the recording data recordable using the amounts of the plurality of inks or said retained amount of each ink.

7. An ink jet cartridge according to claim 4, wherein a different color ink is retained in each of said plurality of ink retaining units.

* * * * *